United States Patent [19]

Tetradis

[11] 4,112,541

[45] Sep. 12, 1978

[54] HANDLE FOR BAGS PARTICULARLY OF NET OR PLASTIC MATERIAL

[76] Inventor: Constantinos Tetradis, 19 Hatzigianni St., Ayos Ioannis Rentis, Attica) Piraeus, Greece

[21] Appl. No.: 802,171

[22] Filed: May 31, 1977

[51] Int. Cl.[2] ..... B65D 33/06

[52] U.S. Cl. ..... 16/114 R; 24/30.5 R; 150/12; 224/50; 229/62

[58] Field of Search ..... 150/12; 224/50, 45 R, 224/52, 55, 45 P; 229/53, 54 R, 62; 16/114 R, 110, 125, 110.5; 24/30.5 R, 30.5 P, 201 C, 204, 245 A, 245 R, 246, 247, 248 B

[56] References Cited

U.S. PATENT DOCUMENTS 3,363,293 1/1968 Nemrod et al. ..... 24/30.5 P 3,548,906 12/1970 Murphy ..... 150/12

3,552,476 1/1971 Tarte ..... 24/201 C

FOREIGN PATENT DOCUMENTS 200,497 11/1958 Austria ..... 24/30.5 P

*Primary Examiner*—Louis K. Rimrodt

*Attorney, Agent, or Firm*—Edmund M. Jaskiewicz

[57] ABSTRACT

A handle for bags particularly of a net or plastic material has a closed loop carrying member to the bottom portion of which is connected a bendable strip substantially parallel to the carrying member. The strip is foldable back upon itself to form two strip portions. Detents and mating recesses are provided on the opposed inner faces of the strip portions to clamp the bag material between the strip portions which are detachably connected by a snap fastener.

4 Claims, 4 Drawing Figures

HANDLE FOR BAGS PARTICULARLY OF NET OR PLASTIC MATERIAL

The present invention relates to a carrying handle for bags, more particularly, to such a carrying handle which is detachably fastened to the open end of the bag.

Bags particularly of a flexible plastic material or a net material are commonly used for carrying a wide variety of relatively small objects. Such bags are particularly popular for use in shopping wherein a number of small articles may be collected at different locations. Net bags are particularly suitable for shopping purposes since the shopper can easily acertain the contents of the bag without opening the bag. Such bags have been provided with many forms of handles or carrying members. Plastic bags in particular have been provided with plastic handles which are bonded or otherwise adhered to the open end of the bag. Such handles are not satisfactory since they are easily separated from the bag under the burden of the contents of the bag and eventually the handles are useless. Handles have also been secured to bags by various forms other than gluing or adhering. However, such handles are also generally unsatisfactory since the structure for securing the handles to the bag is either too complicated so as to be too difficult to be readily operated by the user or else the bag is not securely attached to the handle.

It is therefore the principal object of the present invention to provide a novel and improved handle for bags particularly of a net or plastic material.

It is another object of the present invention to provide such a bag handle which is readily attached to and detached from the bag material.

It is a further object of the present invention to provide a detachable bag handle which is securely clamped to the bag material to provide a reliable and longlasting carrying member.

According to one aspect of the present invention a handle for bags particularly of a net or plastic material may comprise a carrying member having an elongated portion which is to be gripped by the hand of the user. A bendable strip is attached to the carrying member and is foldable back upon itself so as to form two portions having opposed inner surfaces. A snap fastener on one strip portion is detachably engageable with the other strip portion to clamp the strip portions together. The opposed inner surfaces of the strip portions are provided with means for gripping bag material received between the strip portions so that the handle is securely but detachably attached to the bag material when the strip portions are clamped together by the snap fastener.

The carrying member of the handle may be of a plastic material and the entire handle may be of integral construction. The gripping structure on the strip portions may comprise detents on one strip portion which mate with recesses on the other strip portion.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment and modifications of the present invention will be described in detail.

Figure 1:
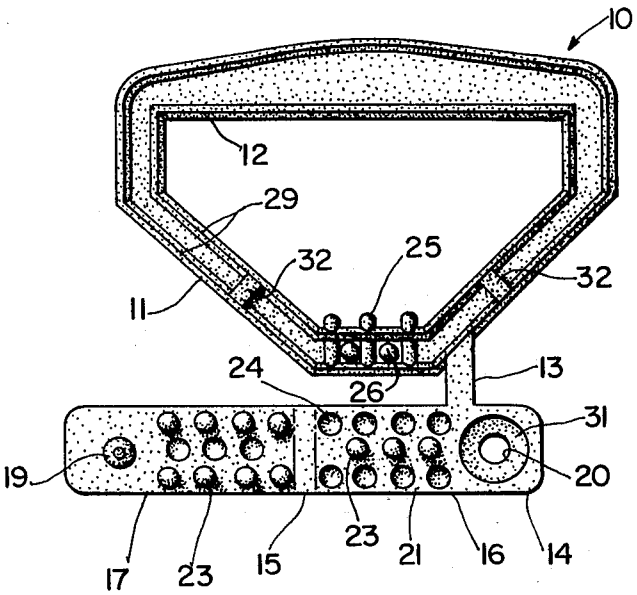
FIG. 1 is an elevational view of the handle according to the present invention in the open position.

The handle according to the present invention is indicated generally at 10 in FIG. 1 and comprises a closed loop carrying member 11 having an elongated portion 12 which is manually gripped by the user when the handle is attached to a bag and is being carried as will be presently described. The handle is illustrated in its normal carrying position wherein the elongated portion 12 is horizontal and the description of the various directions of the elements will be described with respect to this carrying position for purposes of convenience.

Figure 2:
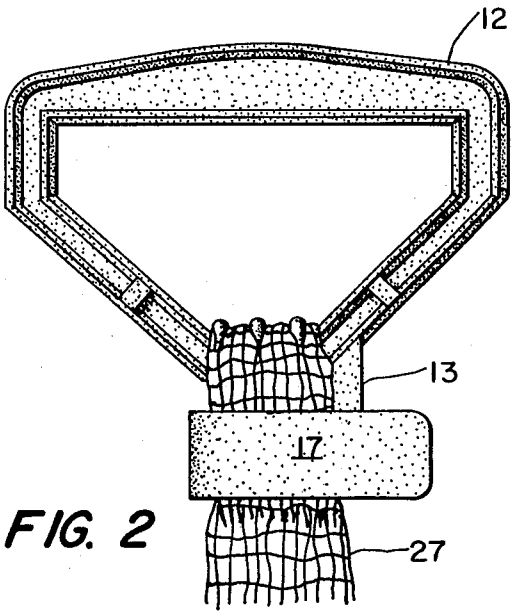
FIG. 2 is a view similar to that of FIG. 1 but showing the handle in the closed position clamped to the bag material.
Figure 3:
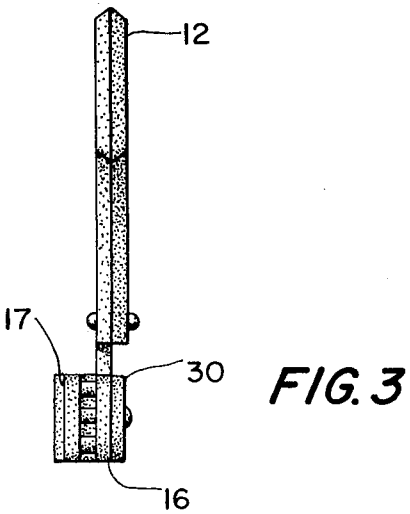
FIG. 3 is an end elevational view of the handle in the closed position.

A substantially vertically extending link 13 connects the lower portion of the carrying member 11 to a bendable strip 14 which is bendable or foldable about one edge 15 so as to form strip portions 16 and 17 which are folded together in the manner as shown in FIG. 2. The strip portions are secured together in a clamped position by a snap fastener comprising a pin 18 having a conical head 19 of an enlarged diameter which is received within an opening 20. The enlarged diameter of the head 19 is only slightly greater than the diameter of the opening 20 so that the head may be inserted into and withdrawn from the opening to engage and disengage the snap fastener.

The strip portions 16 and 17 have opposed inner faces 21 and 22 upon which may be formed a series of detents or pins 23 which may be received into cup-shaped recesses 24 positioned on the inner surfaces in such a manner so as to coincide with the positions of the pins and the detents and recesses are capable of a mating relationship.

Figure 4:
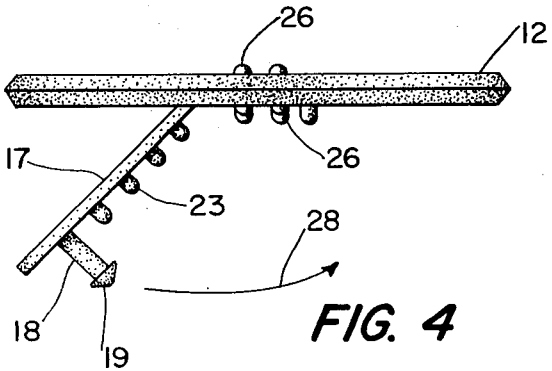
FIG. 4 is a top plan view of the handle showing the movement of a strip portion to the closed position.

A plurality of detents or pins 25 are also positioned in upstanding positions on the inner surface of the carrying handle as shown in FIG. 1 and a plurality of lateral detents 26 are positioned on each side of the lower portion of the carrying handle as also may be seen in FIG. 1 and FIG. 4.

The carrying handle 10 is preferably made of a thermoplastic material and is formed of an integral one-piece construction. The fold 15 of the strip 14 has a smaller thickness than the remainder of the strip 14 so as to facilitate bending of the strip. The plastic material from which the carrying member is formed also facilitates the snap action permitting the engagement and disengagement of the snap fastener.

To use the handle 10 the open end of a net bag a portion of which is illustrated at 27 in FIG. 2 is gathered together and the gathered portion is passed over the detents on one strip portion 16 looped over the detents 25 on the handle and then doubled over against the strip portion 16 into the position as shown in FIG. 2. The strip portion 17 is then moved into the closing position as illustrated by the arrow 28 in FIG. 4 to be clamped upon the doubled over bag material into the position as shown in FIG. 2. In this clamped position it can be seen that the detents 23 and recesses 24 on the strip portions grip the bag material together with the lateral detents 26 and upper detents 25 on the handle. While this gripping action is particularly effective with bags of netted material wherein the detents or pins readily penetrate into the bag material it is to be born in mind that bags of other material such as sheet plastic, fabrics including burlap can also be securely gripped by the clamping strips of this handle.

Should at any time access be desired to the bag supported by the handle 22 the strip portion 17 is pulled away from the strip portion 16 to disengage the snap fastener. With the strip portions in the opened position as shown in FIG. 1 the gathered opening of the bag is then readily released from the handle to permit access to the bag. In a manner similar to that described above the handle is readily attached to the bag opening. The procedure of disengaging the handle and subsequently clamping the handle to the bag material occupies such a short period of time that there is no inconvenience to the user in engaging and disengaging the handle repeatedly during use.

The construction of the handle is sufficiently strong to withstand ordinary operations such as would be carried out with utilizing net or plastic bags by shoppers or other persons. At the same time, the construction is such that the handle may be inexpensively molded from plastic in a known manner.

The inner and outer edges of the closed loop portion 11 of the handle may be provided with widened reinforcing edges or rims 29 to provide a more comfortable handgrip and to strengthen further the handle. If desired, transverse reinforcing ribs 32 may be located at different points along the handle between the upstanding edges indicated at 29.

The opening 20 may be provided on the rearside of the strip with a reinforced annular portion 30 to permit repeated engagement and disengagement of the snap fastener without any damage to the opening. The inner surface of strip 16 surrounding the opening 20 may be formed with a tapering or conical surface 31 leading to the opening 20 so as to facilitate insertion of the head 19 into the opening 20.

It will be understood that this invention is susceptible to modification in order to adapt it to different usages and conditions, and accordingly, it is desired to comprehend such modifications within this invention as may fall within the scope of the appended claims.

What is claimed is:

1. A handle for bags particularly of a net or plastic material comprising a carrying member having an elongated closed loop portion adapted to be gripped manually, a link extending perpendicularly from said closed loop and a bendable strip attached to said link spaced from said closed loop and foldable back upon itself to define two portions having opposed inner surfaces, said strip being substantially parallel to said elongated portion of the carrying member, a snap fastener on one strip portion detachably engageable with the other strip portion to engage said strip portion in a clamped position, and means on the opposed inner surfaces of said strip portions for clampingly engaging bag material received between said strip portions, said clamping means comprising a plurality of detents on one of said strip portions and recesses on the other of said strip portions spaced to correspond with said detents, a bag of flexible material having an opening, the bag material at said opening being gathered together and passed between said clamped strip portions to be doubled around a portion of said carrying member to which said link is attached and passed back between said strip portions so that the handle is securely but detachably fastened to said bag when said strip portions are engaged by said snap fastener.

2. A handle as claimed in claim 1 and further comprising detents on said carrying member engageable by the material of said bag.

3. A handle as claimed in claim 1 wherein said handle is of a plastic material.

4. A handle as claimed in claim 1 wherein said carrying member and foldable strip are integral.

* * * * *